US007014207B2

(12) United States Patent
Humann et al.

(10) Patent No.: US 7,014,207 B2
(45) Date of Patent: Mar. 21, 2006

(54) ARRANGEMENT FOR THE LENGTHWISE ADJUSTMENT OF A SKI BINDING PART

(75) Inventors: Marc Roman Humann, Breitenbrunn (AT); Karl Stritzl, Vienna (AT)

(73) Assignee: Tyrolia Technology GmbH (AT)

( * ) Notice: Subject to any disclaimer, the term of this patent is extended or adjusted under 35 U.S.C. 154(b) by 281 days.

(21) Appl. No.: 10/613,382

(22) Filed: Jul. 3, 2003

(65) Prior Publication Data

US 2004/0051278 A1 Mar. 18, 2004

(30) Foreign Application Priority Data

Jul. 5, 2002 (EP) ..... 02015160

(51) Int. Cl.
*A63C 9/00* (2006.01)

(52) U.S. Cl. ..... 280/633; 280/618; 280/634

(58) Field of Classification Search ..... None
See application file for complete search history.

(56) References Cited

U.S. PATENT DOCUMENTS

| | | | | | |
|---|---|---|---|---|---|
| 3,989,274 | A | * | 11/1976 | Weigl et al. | 280/634 |
| 4,022,493 | A | * | 5/1977 | Weigl et al. | 280/633 |
| 4,817,981 | A | * | 4/1989 | Desbiolles et al. | 280/633 |
| 4,955,633 | A | * | 9/1990 | Stritzl et al. | 280/633 |
| 5,344,179 | A | * | 9/1994 | Fritschi et al. | 280/618 |
| 5,348,335 | A | * | 9/1994 | Dasarmaux et al. | 280/633 |
| 5,732,968 | A | | 3/1998 | Wladar et al. | 280/633 |
| 5,794,962 | A | * | 8/1998 | Bardin et al. | 280/607 |
| 5,975,555 | A | * | 11/1999 | Lehner et al. | 280/618 |
| 6,050,591 | A | * | 4/2000 | Bardin et al. | 280/633 |
| 6,092,829 | A | * | 7/2000 | Mercier | 280/617 |
| 6,824,158 | B1 | * | 11/2004 | Keller et al. | 280/618 |

FOREIGN PATENT DOCUMENTS

| | | |
|---|---|---|
| FR | 2 578 434 | 9/1986 |
| FR | 2632200 | 12/1989 |
| FR | 2777473 | 10/1999 |
| WO | WO 88 04562 | 6/1988 |

OTHER PUBLICATIONS

German Search Report.

* cited by examiner

*Primary Examiner*—Christopher P. Ellis
*Assistant Examiner*—Christopher Bottorff
(74) *Attorney, Agent, or Firm*—Ostrolenk, Faber, Gerb & Soffen, LLP

(57) ABSTRACT

The invention relates to an arrangement for the lengthwise adjustment of a ski binding part arranged on a rail, which is fixed to the ski, so as to slide in the lengthwise direction of the ski by means of a base-plate or the like, wherein a locking part, which is subject to the action of at least one spring and can be locked on the rail in different positions, is mounted on the base-plate, this locking part being actively connected to an actuation lever, which is arranged so as to rotate on the base-plate, in order to release the locking, and being lockable on the rail which is fixed to the ski, in the lengthwise direction of the ski, by means of this actuation lever. The actuation lever (9) is pressed against the rail (2) while being pretensioned in the locked position of the locking part (4).

5 Claims, 2 Drawing Sheets

A-A
13a
2
2a
3
4
8

1
6
4
A
3
13a
13
P
11
9
10
8
7
A

ARRANGEMENT FOR THE LENGTHWISE ADJUSTMENT OF A SKI BINDING PART

BACKGROUND OF THE INVENTION

1. Field of the Invention

The invention relates to an arrangement for the lengthwise adjustment of a ski binding part arranged on a rail, which is fixed to the ski, so as to slide in the lengthwise direction of the ski by means of a base-plate or the like, wherein a locking part, which is subject to the action of at least one spring and can be locked on the rail in different positions, is mounted on the base-plate, this locking part being actively connected to an actuation lever, which is arranged so as to rotate on the base-plate, in order to release the locking, and being lockable on the rail which is fixed to the ski, in the lengthwise direction of the ski, by means of this actuation lever.

2. Description of the Related Art

Such an arrangement is known from U.S. Pat. No. 5,794,962. In order to avoid the play between the base-plate and the guide rail which can sometimes arise owing to manufacturing tolerances, a separate element is provided which can be moved by the actuation lever. This movable element may consist of a shoe, which can be displaced in or under the base-plate, level with the inner side of the rail. The actuation lever is connected to this shoe by a hinged part, which forms a knee joint with the actuation lever, so that the shoe is pressed against the side of the slide rail and held in this state when the lock and the actuation lever are in their position corresponding to the locked setting.

SUMMARY OF THE INVENTION

The invention eliminates the play between the base-plate and the guide rail in a substantially more straightforward but nevertheless reliable and expedient way in an arrangement of the type mentioned at the start.

This result is achieved according to the invention in that the actuation lever is pressed against the rail while being pretensioned in the locked position of the locking part.

In the invention, undesired play between the base-plate of the ski binding part and the guide rail is therefore prevented by the actuation lever itself. The function of the actuation lever for unlocking the locking part remains unaffected by this.

According to an embodiment of the invention, under the effect of the spring which acts on the locking part, the actuation lever has an actuation appendage engaging with the locking part. The required connection between the actuation lever and the locking part is hence produced in a straightforward way.

Furthermore, the actuation lever has a deformable support part which enters in contact with the guide rail. This provides the pretension which is required so that the actuation lever is pressed against the rail in order to eliminate the play.

In order to be able to release easily the wedging between the actuation lever and the rail, it is furthermore advantageous if the side of the support part of the actuation lever which enters in contact with the guide rail is designed to be rounded, so that the contact of the actuation lever with the rail is released when the locking part is unlocked using the actuation lever.

The deformability of the support part can thus be provided by the material which is used, for example sheet-steel, together with the shape selected for it, although the support part may alternatively be separated from the remaining region of the actuation lever by a groove, a slot or the like.

The invention furthermore relates to a ski binding part or a ski binding, which is provided with an arrangement according to one or more of the disclosed features.

BRIEF DESCRIPTION OF THE DRAWINGS

Further features, advantages and details of the invention will now be described in more detail with reference to the drawings, which represent an exemplary embodiment, and in which.

DETAILED DESCRIPTION OF THE PREFERRED EMBODIMENTS

Figures 1, 2:
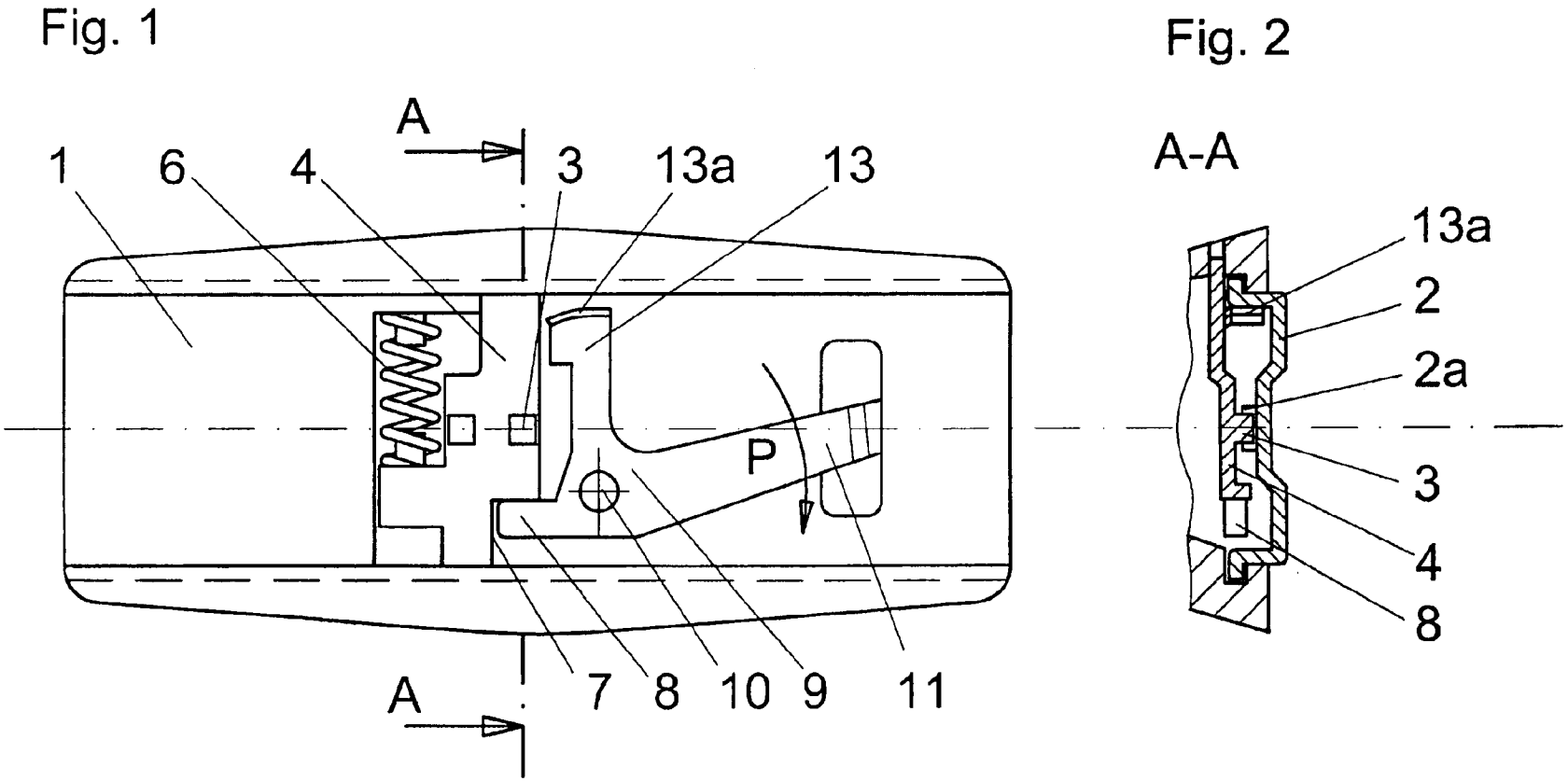
FIG. 1 shows a view from below of a base-plate of a ski binding.
FIG. 2 shows a cross section through a base-plate on the line II—II in FIG. 1, the base-plate here being represented as fitted onto a guide rail fixed to the ski.

As shown in particular by FIG. 2, a guide rail 2 is provided which is arranged fixed to the ski, for example screwed to a ski shown only schematically here, and whose lateral edges extending in the lengthwise direction of the ski are designed to be bent back so that a base-plate 1 of a ski binding part (not otherwise shown), with guides correspondingly bent inwards and also extending in the lengthwise direction of the ski, can be fitted onto the guide rail 2 fixed to the ski, and is arranged so that it can be displaced relative to it in the lengthwise direction of the ski. In the embodiment which is represented, the base-plate 1 is a front ski binding part.

A series of ridges 2*a* (see FIG. 2) extending along the lengthwise direction of the ski is formed on the upper side of the rail 2 fixed to the ski, into the intermediate spaces of which ridges projections 3 can be latched which are designed rectangularly in the embodiment which is represented. The projections 3 are formed on the lower side of a locking part 4, which is arranged or guided displaceably in the transverse direction in a recess of the base-plate 1.

In the locked setting, the locking part 4 is inwardly supported, while being subjected to the action of a compression spring 6, in the region of the one edge region of the base-plate 1 extending in the lengthwise direction of the ski. In the embodiment which is represented, the compression spring 6 acts on the locking part 4 in its one region extending in the transverse direction, through the formation of a corresponding spring bearing point here. The second end of the compression spring 6 is supported on a bearing point formed on the base-plate 1.

Diagonally opposite from the compression spring 6, a recess 7 is provided on the locking part 4, which recess is designed roughly rectangularly in the embodiment which is represented and in which recess an actuation appendage 8 of the actuation lever 9 engages. The actuation lever 9 is mounted so that it can rotate about an axis 10 on the base-plate 1. As viewed in the lengthwise direction of the ski, the actuation appendage 8 is in engagement with the locking part 4 on the one side of the axis 10 and, on the other side of the axis 10, the actuation lever 9 is provided with a handle 11, which is an elongately designed part that projects outwards or is guided out from the ski binding part, so that the end region of the actuation lever 9 can be gripped by hand.

In its region opposite to the actuation appendage 8 and assigned to the one edge, extending in the lengthwise direction of the ski, of the guide rail 2 fixed to the ski, the actuation lever 9 has a support part 13, which points in the direction of the handle 11 and which has an edge region bent around in the direction of the rail 2. By means of the support part 13, which is flexible or somewhat deformable, the actuation lever 9 wedges internally on the rail 2 when the locking part 4 is engaged. The locking part which is under the effect of the spring 6 acts via the actuation appendage 8 on the lever 9 in such a way as to maintain the wedging. On the outside, the support part 13 is provided with a rounding 13*a* whose curvature is not concentric with the axis 10, but rather is designed so that the wedging with the rail 2 is released as quickly as possible when the locking part 4 is unlocked using the actuation lever 9.

In the locked setting shown in FIG. 1, the compression spring 6 presses the projections 3 of the locking part 4 into the ridges 2*a* of the rail 2 and, as already mentioned, presses the actuation lever 9 inwardly onto the guide rail 2 via the locking part 4.

In order to be able to adjust or change the position of the ski binding part relative to the rail 2 fixed to the ski, the handle 11 of the actuation lever 9 is rotated in the direction of the arrow P, so that the actuation lever 9 is rotated about the axis 10. By this rotational movement, the locking part 4 is displaced in the transverse direction using the actuation appendage 8, so that its projections 3 disengage from the ridges of the rail 2. At the same time, the support part 13 is freed from the rail 2 via the eccentric rounding 13*a* and by releasing the wedging, so that the actuation lever 9 allows free mobility of the base-plate 1. As soon as the ski binding part has entered the desired position relative to the rail 2 fixed to the ski, the actuation lever 9 is reset, so that both projections 3 of the locking part 4 re-engage between ridges of the rail 2, the actuation lever 9 together with the locking part 4 is returned to the starting position and the support part 13*a* is also re-wedged on the rail 2.

Figure 3:
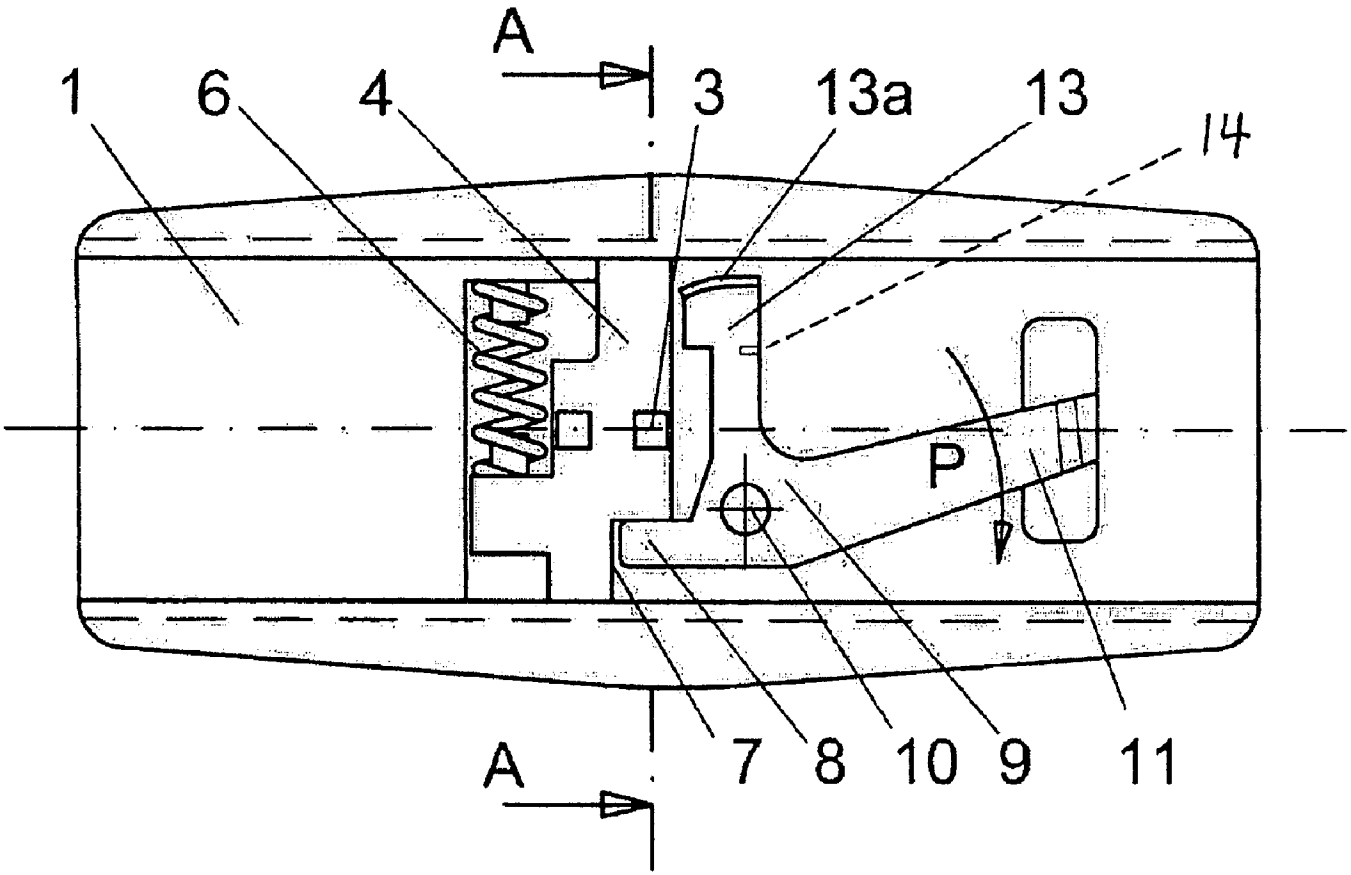
FIG. 3 is a view similar to that in FIG. 1, showing schematically a slot 14 separating the support part 13 from the remaining parts of the actuation lever 9.

The invention is not restricted to the exemplary embodiment which has been represented. For instance, the support part provided on the actuation lever 9 may be a part which is partially separated from the remaining region of the actuation lever by a groove, a slot or the like, such as the slot 14 shown schematically in FIG. 3. The arrangement of the compression spring which acts on the locking part may also be configured differently.

What is claimed is:

1. Arrangement for the lengthwise adjustment of a ski binding part arranged on a rail, which is fixed to the ski, so as to slide in the lengthwise direction of the ski by means of a base-plate, wherein a locking part, which is subject to the action of at least one sprint and can be locked on the rail in different positions, is mounted on the base-plate, said locking part being actively connected to an actuation lever, which is arranged so as to rotate on the base-plate, in order to release the locking, and being lockable on the rail which is fixed to the ski, in the lengthwise direction of the ski, by means of this actuation lever, and wherein the actuation lever is pressed against the rail while being pretensioned in the locked position of the locking part;

wherein the actuation lever has a deformable support part which enters into contact with the guide rail.

2. Arrangement according to claim 1, wherein, under the effect of the spring which acts on the locking part, the actuation lever has an actuation appendage engaging with the locking part.

3. Arrangement according to claim 1, wherein the side of the support part of the actuation lever which enters into contact with the guide rail is rounded, so that the contact of the actuation lever with the rail is released when the locking part is unlocked using the actuation lever.

4. Arrangement according to claim 1, wherein the support part is separated from the remaining region of the actuation lever by a groove, a slot or a spacing.

5. Ski binding part or ski binding, which is provided with an arrangement according to any one of claims 1 to 4.

* * * * *